US009280080B2

(12) United States Patent
Uenishi et al.

(10) Patent No.: US 9,280,080 B2
(45) Date of Patent: Mar. 8, 2016

(54) CHARGER AND IMAGE FORMING APPARATUS

(71) Applicants: Hiroyuki Uenishi, Kanagawa (JP); Toshiya Sato, Kanagawa (JP); Norio Kudoh, Kanagawa (JP); Tomohiko Saito, Kanagawa (JP)

(72) Inventors: Hiroyuki Uenishi, Kanagawa (JP); Toshiya Sato, Kanagawa (JP); Norio Kudoh, Kanagawa (JP); Tomohiko Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/546,269

(22) Filed: Nov. 18, 2014

(65) Prior Publication Data

US 2015/0147083 A1 May 28, 2015

(30) Foreign Application Priority Data

Nov. 26, 2013 (JP) ..... 2013-244375
May 22, 2014 (JP) ..... 2014-106091
Nov. 13, 2014 (JP) ..... 2014-230922

(51) Int. Cl.
*G03G 15/02* (2006.01)

(52) U.S. Cl.
CPC ..... *G03G 15/0258* (2013.01)

(58) Field of Classification Search
CPC ..... G03G 15/0258; G03G 2215/028
See application file for complete search history.

(56) References Cited

U.S. PATENT DOCUMENTS 5,264,903 A * 11/1993 Nagame et al. ..... 399/357
5,687,054 A * 11/1997 Takada et al. ..... 361/225

FOREIGN PATENT DOCUMENTS

JP 5-297688 11/1993
JP 9-244357 9/1997

* cited by examiner

*Primary Examiner* — Roy Y Yi
(74) *Attorney, Agent, or Firm* — Harness, Dickey & Pierce, P.L.C.

(57) ABSTRACT

A charger is provided. The charger includes a discharge electrode, a cleaner, and a holder. The discharge electrode is composed of a wire, and the wire has a surface plated with palladium. The cleaner removes foreign substances adhered to the discharge electrode. The cleaner includes a first cleaner composed of a glass-containing resin and a second cleaner. The first cleaner scrapes off the foreign substances by press-contacting the wire while moving, and the second cleaner wipes off the foreign substances by press-contacting the wire while moving. The holder movably holds the cleaner in a direction parallel to the discharge electrode.

20 Claims, 10 Drawing Sheets

IN BACKWARD MOVEMENT

IN FORWARD MOVEMENT

CHARGER AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2013-244375, 2014-106091, and 2014-230922 filed on Nov. 26, 2013, May 22, 2014, and Nov. 13, 2014, respectively, in the Japan Patent Office, the entire disclosure of each of which is hereby incorporated by reference herein.

BACKGROUND

1. Technical Field

The present disclosure relates to a charger and an electrophotographic image forming apparatus such as copier, facsimile machine, and scanner, in particular, using the charger.

2. Description of the Related Art

As a useful charger for charging a surface of photoreceptor in image forming apparatus, corona charger employing corona discharge is known. In corona charger, a wire is serving as a discharge electrode. As the wire is contaminated with powder dust such as toner or corona discharge products, the discharge electrode gets less able to uniformly discharge. The resulting image may be accompanied by black or white strip-like or band-like abnormal image and/or image density unevenness. The life-span of the charger is constrained by the degree of wire contamination, and therefore an effective method for removing foreign substances from the wire is demanded. In attempting to solve this problem, the use of a wire cleaner which is composed of felt pad, brush, abrasive-containing non-woven fabric, glass-containing resin, etc., has been proposed. As another approach, a gold-plated wire has been proposed for the purpose of facilitating the removal of foreign substances from the wire.

Glass-containing resin is said to have the best cleaning ability among various materials used for wire cleaners. However, glass-containing resin will scrape off not only foreign substances but also gold plating. A portion of the wire where the gold plating has been scraped off will deteriorate in discharging function and will cause black strip-like or band-like abnormal image. Accordingly, glass-containing resin can be improved in cleaning ability to the extent that gold plating will not be scraped off, which may be insufficient in terms of cleaning ability.

SUMMARY

In accordance with some embodiments of the present invention, a charger is provided. The charger includes a discharge electrode, a cleaner, and a holder. The discharge electrode is composed of a wire, and the wire has a surface plated with palladium. The cleaner removes foreign substances adhered to the discharge electrode. The cleaner includes a first cleaner composed of a glass-containing resin and a second cleaner. The first cleaner scrapes off the foreign substances by press-contacting the wire while moving, and the second cleaner wipes off the foreign substances by press-contacting the wire while moving. The holder movably holds the cleaner in a direction parallel to the discharge electrode.

In accordance with some embodiments of the present invention, an image forming apparatus is provided. The image forming apparatus includes an image carrier, the above-described charger, a latent image forming device, a developing device, a transfer device, and a fixing device. The charger charges a surface of the image carrier. The latent image forming device forms an electrostatic latent image on the charged surface of the image carrier. The developing device develops the electrostatic latent image into a toner image. The transfer device transfers the toner image from the image carrier onto a recording medium. The fixing device fixes the toner image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
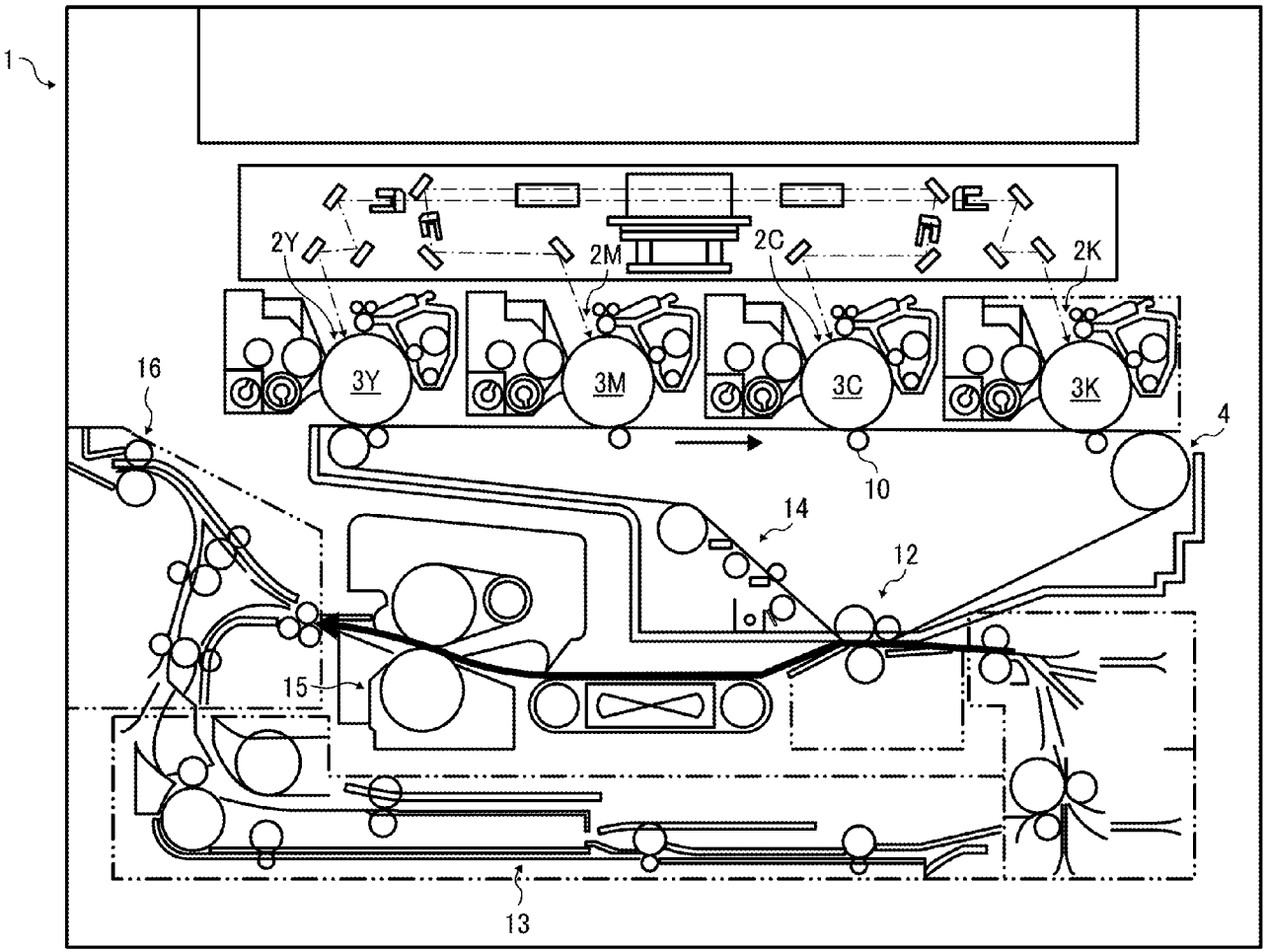
FIG. 1 is a schematic front view of an image forming apparatus according to an embodiment of the present invention.

One object of the present invention is to provide a charger containing a plated wire, serving as a discharge electrode, having the following properties.

(1) The wire is prevented from being contaminated with foreign substances.

(2) The plating of the wire is prevented from peeling off.

(3) The charger suppresses the occurrence of black or white strip-like or band-like abnormal image and/or image density unevenness.

(4) The charger has an extremely long life-span.

According to an embodiment of the present invention, the wire, serving as a discharge electrode, is plated with palladium, and the wire cleaner consists of the first cleaner composed of a glass-containing resin and the second cleaner. With such a configuration, the plating can maintain foreign-substance removability without causing peeling off. Thus, even strongly-adhered foreign substances can be easily removed from the wire, suppressing the occurrence of black or white strip-like or band-like abnormal image and/or image density unevenness and drastically extending the life-span of the charger.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 2:
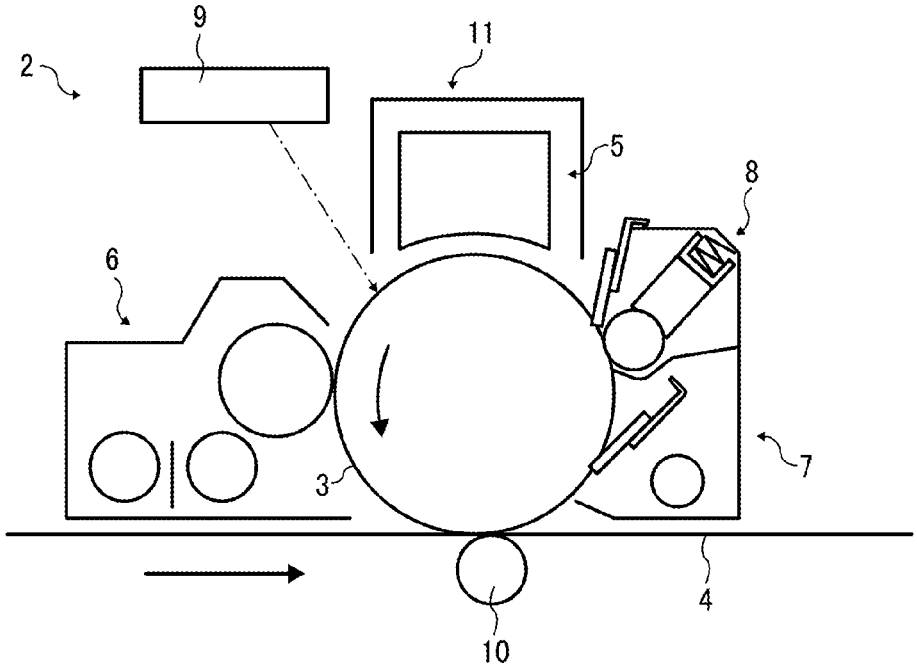
FIG. 2 is a schematic view of a process cartridge according to an embodiment of the present invention.

FIG. 1 shows an image forming apparatus 1 according to an embodiment of the present invention, which is a full-color copier. FIG. 2 shows a process cartridge 2 mountable on the image forming apparatus 1. The image forming apparatus 1 includes four process cartridges 2Y, 2M, 2C, and 2K for the respective colors of yellow, magenta, cyan, and black. Each of the process cartridges 2 contains a photosensitive drum 3 serving as an image carrier. Each of the photosensitive drums 3Y, 3M, 3C, and 3K rotates while contacting an intermediate transfer belt 4 serving as an intermediate transfer member.

Referring to FIG. 2, the process cartridge 2 includes a scorotron corona charger 5 (hereinafter simply "charger 5") to charge a surface of the photosensitive drum 3 covered with a fan duct 11 provided to the main body of the apparatus. The process cartridge 2 further includes a developing device 6 to develop an electrostatic latent image formed on a surface of the photosensitive drum 3 into a visible image with each toner and a cleaner 7 to collect residual toner particles remaining on the surface of the photosensitive drum 3 after the toner image has been transferred therefrom. The process cartridge 2 further includes a lubricant applicator 8 to apply lubricant to the surface of the photosensitive drum 3 for its protection. These members are detachably allocated around the photosensitive drum 3.

In the process cartridge 2, a surface of the photosensitive drum 3 is charged by the charger 5, and the charged surface is exposed to laser light emitted from a latent image forming device 9 to form an electrostatic latent image. The developing device 6 is supplied with a predetermined amount of toner from a toner bottle. The developing device 6 then develops the electrostatic latent image into a toner image that is visible. The toner image is primarily transferred onto the intermediate transfer belt 4 by a primary transfer device 10. After the primary transfer of the toner image, residual toner particles remaining on the photosensitive drum 3 are collected by the cleaner 7 and conveyed to a waste toner container provided to the main body through a conveyance path. After residual toner particles are collected by the cleaner 7, the lubricant applicator 8 applies a lubricant to the surface of the photosensitive drum 3 to form a surface protection layer.

Toner images of yellow, magenta, cyan, and black are sequentially transferred from respective photosensitive drum 3 in each process cartridge 2 onto the intermediate transfer belt 4. The timing of imaging operation is sequentially shifted among the four process cartridges 2 from upstream side to downstream side with respect to the direction of movement of the intermediate transfer belt 4 so that the toner images are superimposed on one another at the same position on the intermediate transfer belt 4. The composite toner image on the intermediate transfer belt 4 is conveyed to a position of a secondary transfer device 12 and secondarily transferred onto a paper sheet serving as a recording medium having been conveyed from a paper feeder 13 to the position in synchronization with an entry of the composite toner image thereto. After the secondary transfer of the composite toner image, residual toner particles remaining on the intermediate transfer belt 4 are collected by an intermediate transfer cleaner 14 and conveyed to a waste toner container provided to the main body. The paper sheet onto which the composite toner image has been secondarily transferred is conveyed to a fixing device 15. The composite toner image is fixed on the paper in the fixing device 15 and discharged by a discharge roller 16.

Figure 3:
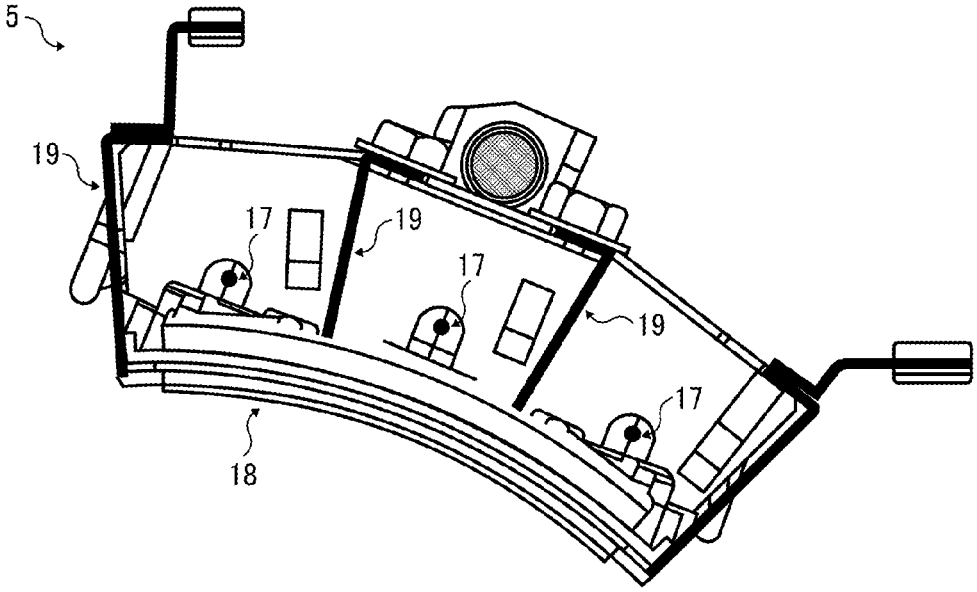
FIG. 3 is a schematic view of a charger according to an embodiment of the present invention.
Figure 4:
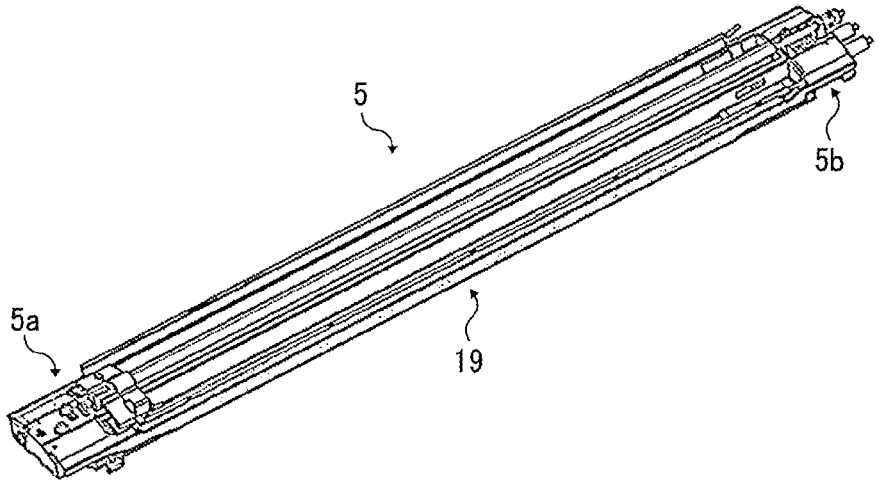
FIG. 4 is a schematic view of a charger according to an embodiment of the present invention.
Figure 5:
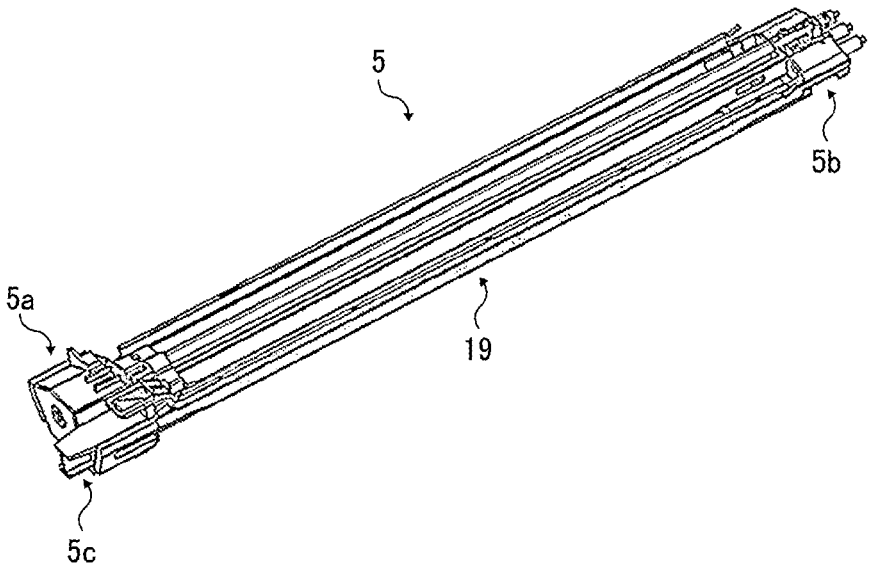
FIG. 5 is a schematic view of a charger according to an embodiment of the present invention.

Details of the charger 5 according to an embodiment of the present invention are described below. Referring to FIGS. 3 to 5, the charger 5 includes a corona wire 17 to be applied with a high voltage, a mesh-like grid electrode 18 disposed between the corona wire 17 and a surface of the photoreceptor 3, and a casing 19 serving as an opposite electrode to the corona wire 17. Each of the corona wire 17, grid electrode 18, and casing 19 is held by a front part 5*a* and a rear part 5*b* of the charger 5. The front part 5*a* and rear part 5*b* have specific shapes that determine the position of the charger 5. The front part 5*a* is equipped with a cover 5*c*. The charger 5 is configured to be mountable on and detachable from the image forming apparatus 1 from the front side thereof. The cover 5*c* is adapted for grasping at the time the charger 5 is mounted on or detached from the image forming apparatus 1.

The corona wire 17 is composed of tungsten and has a wire diameter of 60 μm. The grid electrode 18 is composed of SUS304 and has a board thickness of 0.1 mm. The casing 19 is composed of SUS304 and has a board thickness of 0.8 mm. The surface of the corona wire 17 has a palladium plating having a thickness of 1.5 μm. In the related art, corona wires are generally plated with gold, which has the lowest ionization tendency and high foreign-substance removability. However, there has been a problem that gold plating easily peels off when cleaned with a cleaner having a high cleaning ability. To solve this problem, palladium plating is employed in the present embodiment of the invention. Palladium plating, having a Vickers hardness of 230 HV, is harder than gold plating, having a Vickers hardness of 30 HV. Palladium plating is less likely to peel off and has a lower ionization tendency and a higher foreign-substance removability than gold plating.

Referring to FIGS. 6 to 11, the charger 5 is equipped with a wire cleaner 20, a grid cleaner 21, and means for moving the cleaners 20 and 21 in a longitudinal direction of the charger 5. The wire cleaner 20 consists of a first cleaner 20*a*, composed of a glass-containing resin, to scrape off foreign substances from the wire, and a second cleaner 20*b* to wipe off the foreign substances. The second cleaner 20*b* is attached to the first cleaner 20*a* with a double-faced tape. The wire cleaner 20 has a hole 20*c* to which a support shaft 22*a*, to be described later, is inserted, a projection 20*d*, and a rib 20*e*.

In the present embodiment, three corona wires 17 are provided and therefore three wire cleaners 20 are provided. Each of the wire cleaners 20 is rotatably supported by a cleaner holder 22. The cleaner holder 22 has three support shafts 22*a*. Each of the support shafts 22*a* is inserted into each of the holes 20*c* on each of the wire cleaners 20 and retained with a retaining ring 23. The cleaner holder 22 has a rotation stopper 22*b*, a detection surface 22*c*, and a hole 22*d*. The hole 22*d* is provided on an upper part and its inner surface is formed into a helical shape. A feed screw 24 provided to the charger 5 is screwed into the hole 22*d*. A driver provided to the main body of the image forming apparatus is controlled by a controller to rotate the feed screw 24. As the feed screw 24 rotates, the cleaner holder 22 is moved in a longitudinal direction of the charger 5.

The image forming apparatus 1 has a drive controller that controls the wire cleaner 20 to regularly and automatically perform a cleaning operation. To prevent the cleaner holder 22 from rotating on the feed screw 24 while moving during the cleaning operation, the cleaner holder 22 supports the casing 19 by sandwiching it with the rotation stopper 22*b*.

If the wire cleaner 20 exists within an image area during an image forming operation, abnormal image may be produced due to the occurrence of defective discharge. To reliably keep the wire cleaner 20 out of the image area, i.e., keep the wire cleaner 20 at the front side, in the present embodiment, a photointerrupter is provided that detects the position of the wire cleaner 20 as the detection surface 22*c* passes thereby. The cleaner holder 22 is further equipped with the grid cleaner 21 composed of foamed polyurethane.

Figure 12:
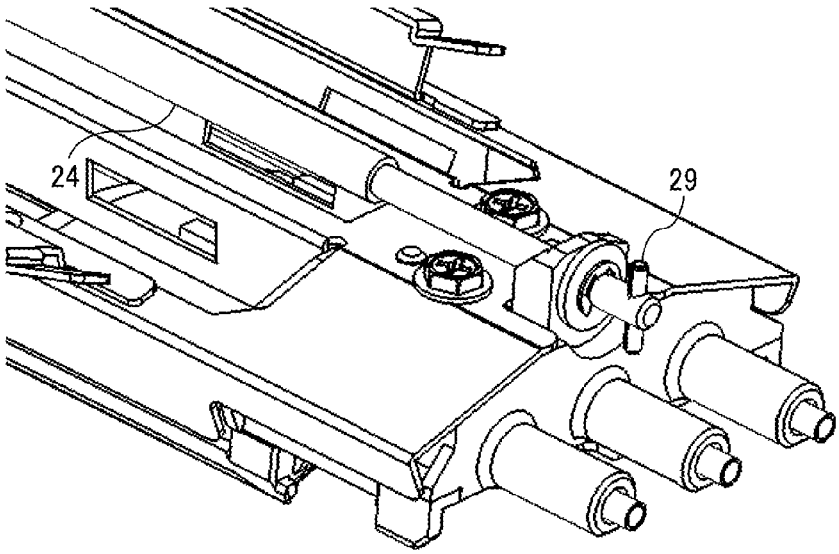
FIG. 12 is a schematic view of a charger according to an embodiment of the present invention.

Referring to FIG. 12, a pin 29 for transmitting driving force is disposed on an end of the feed screw 24 of the charger 5.

Figure 13:
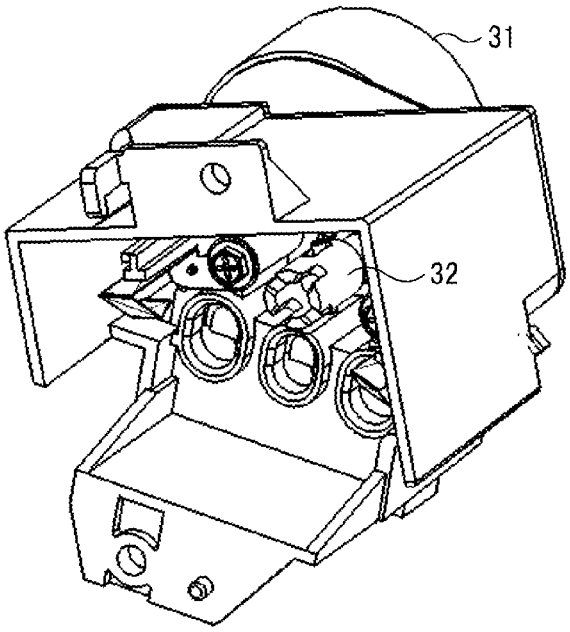
FIG. 13 is a schematic view of a driver according to an embodiment of the present invention.
Figure 14:
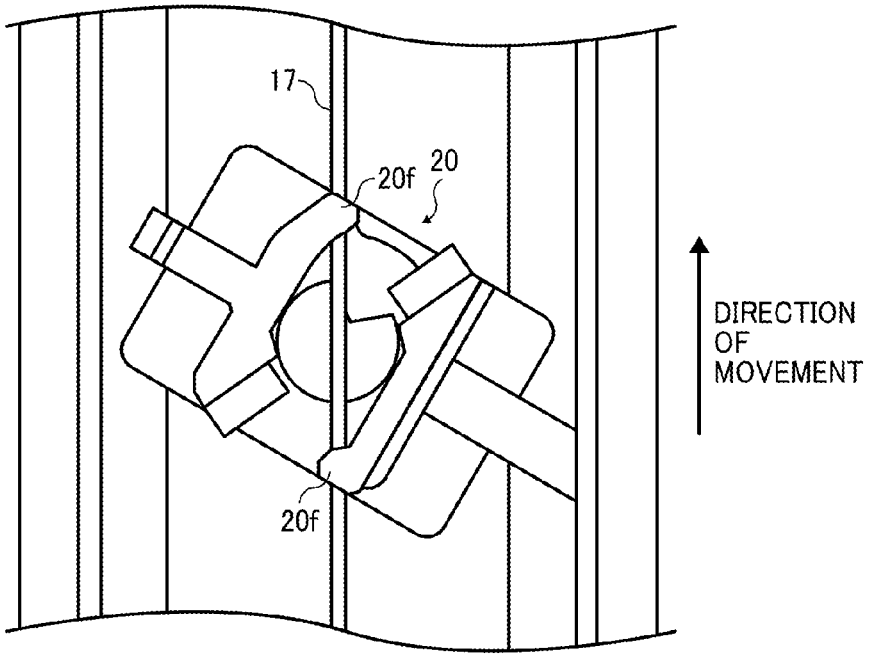
FIG. 14 is a schematic view of a wire cleaner according to an embodiment of the present invention.
Figure 15:
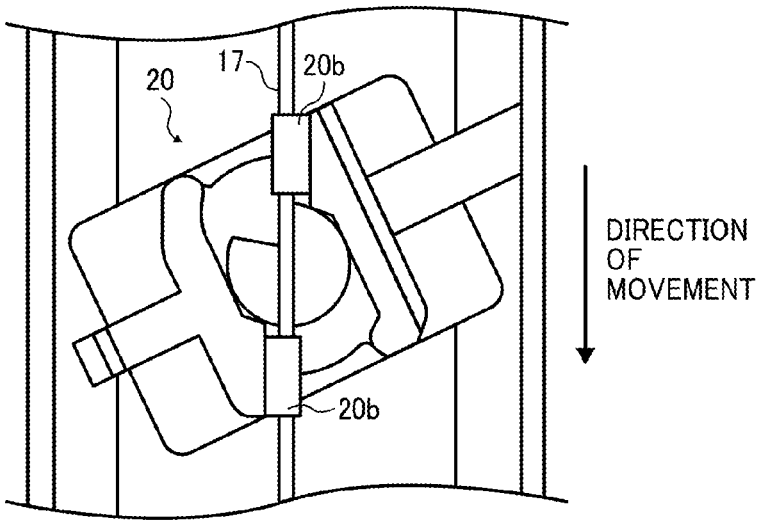
FIG. 15 is a schematic view of a wire cleaner according to an embodiment of the present invention.
Figure 16:
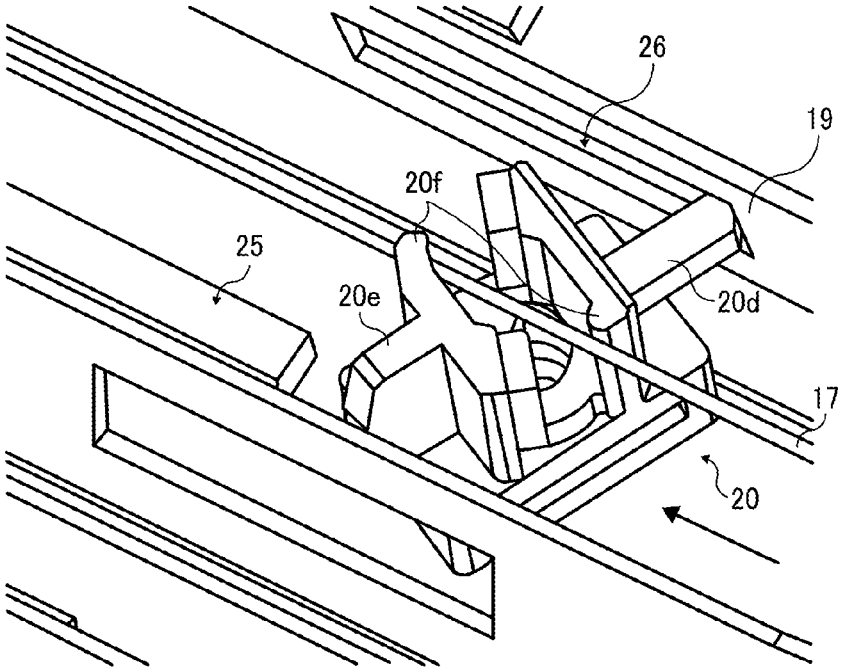
FIG. 16 is a schematic view of a wire cleaner according to an embodiment of the present invention.
Figure 17:
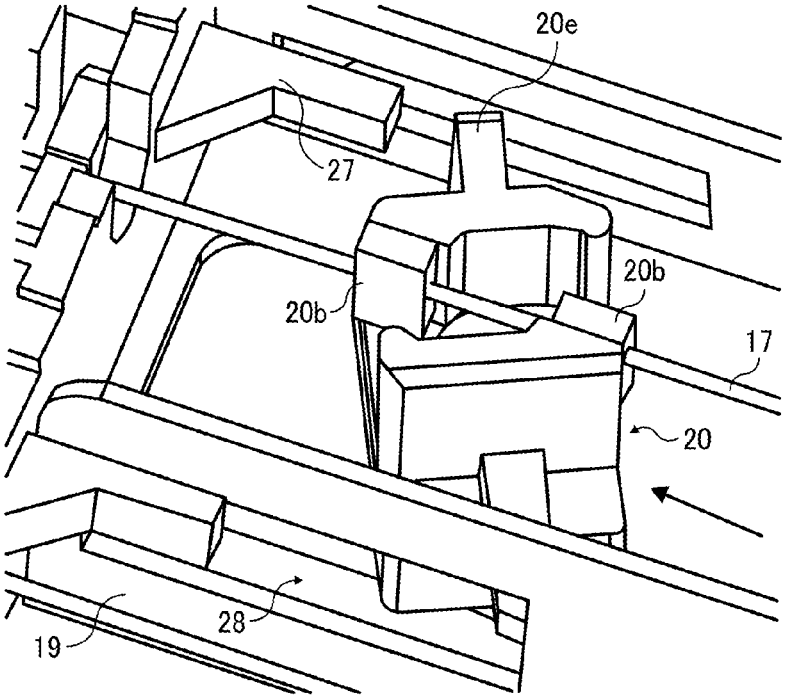
FIG. 17 is a schematic view of a wire cleaner according to an embodiment of the present invention.

A driver 30 for driving the charger 5 is disposed in the main body of the image forming apparatus. Referring to FIG. 13, the driver 30 has a stepping motor 31 serving as a drive source. The driver 30 is configured to transmit driving force to a coupling 32 through a gear. By engaging the coupling 32 with the pin 29 disposed in the charger 5, the rotation of the motor is transmitted to the feed screw 24 to move the cleaner holder 22 in a longitudinal direction.

A controller for controlling the driver 30 is disposed in the image forming apparatus. When moving from the front side to the rear side, the wire cleaner 20 is controlled to move a distance equivalent to a predetermined pulse number of the stepping motor 31. After a stop, the wire cleaner 20 is turned around to start moving forward. From a detection of the detection surface 22*c* by the photointerrupter that is disposed on a front side of the image forming apparatus, the wire cleaner 20 is moved forward a distance equivalent to a predetermined pulse number of the stepping motor 31 and stopped, terminating the cleaning operation.

When moving the wire cleaner 20 either from the front side to the rear side or from the rear side to the front side, in a case in which the photointerrupter never detects the detection surface 22*c* even after a predetermined time period, the cleaning operation is interrupted with displaying an error of the driver 30 or the charger 5 on the operating panel. To regularly and automatically perform the cleaning operation, the controller has a counter for counting the number of prints. As the counter reaches a predetermined number, the cleaning operation is automatically performed and then the counter is reset to zero. The predetermined number is changeable through the operating panel. The counter can be controlled based on the travel distance of the photosensitive drum, etc., in place of the number of prints.

Figure 6:
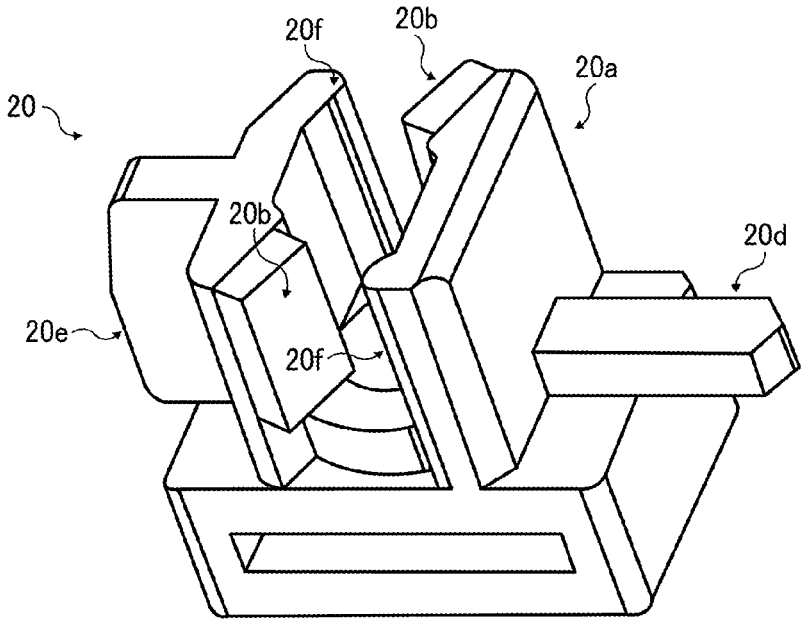
FIG. 6 is a schematic view of a wire cleaner according to an embodiment of the present invention.
Figure 7:
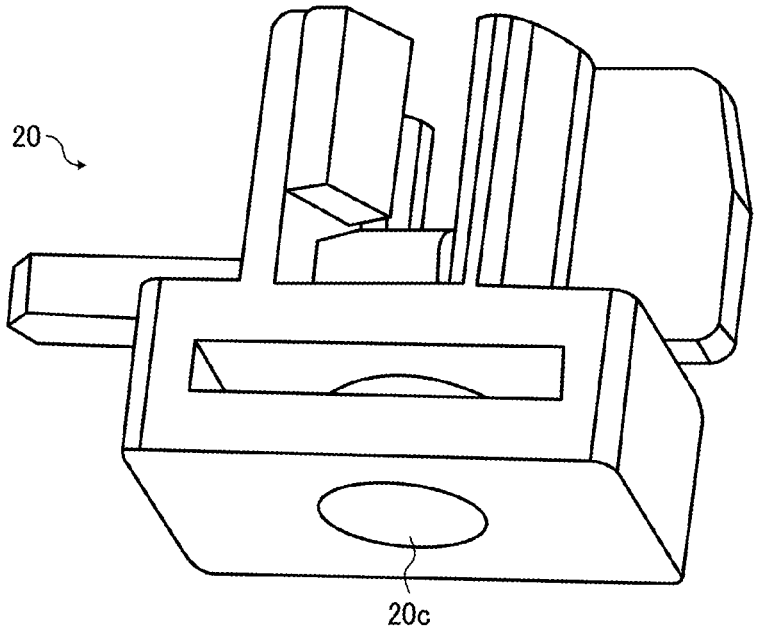
FIG. 7 is a schematic view of a wire cleaner according to an embodiment of the present invention.
Figure 8:
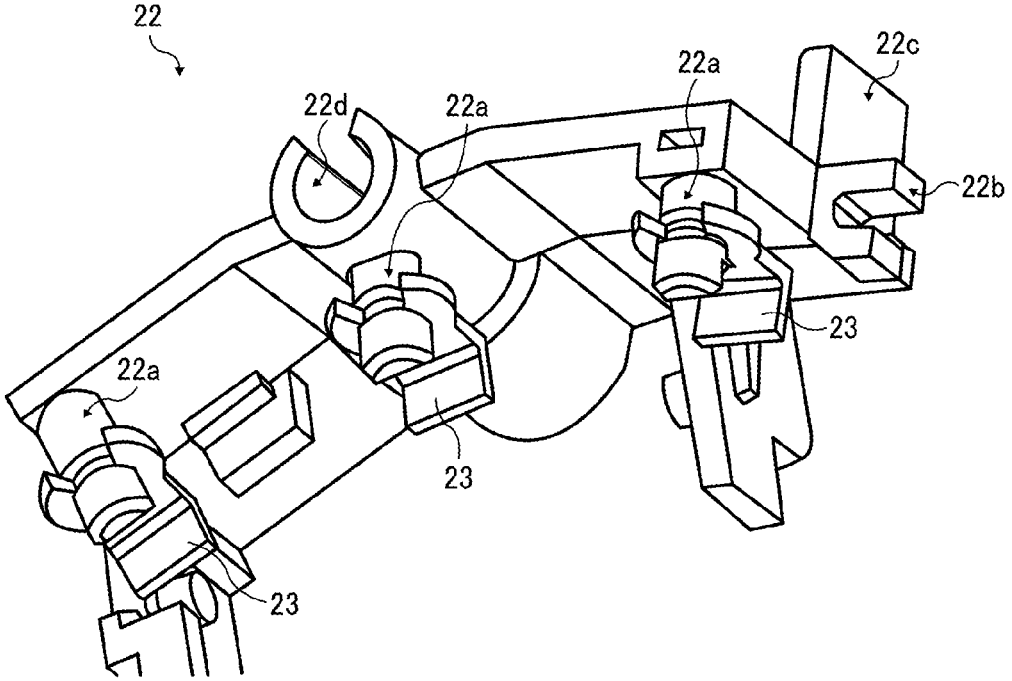
FIG. 8 is a schematic view of a wire cleaner according to an embodiment of the present invention.
Figure 9:
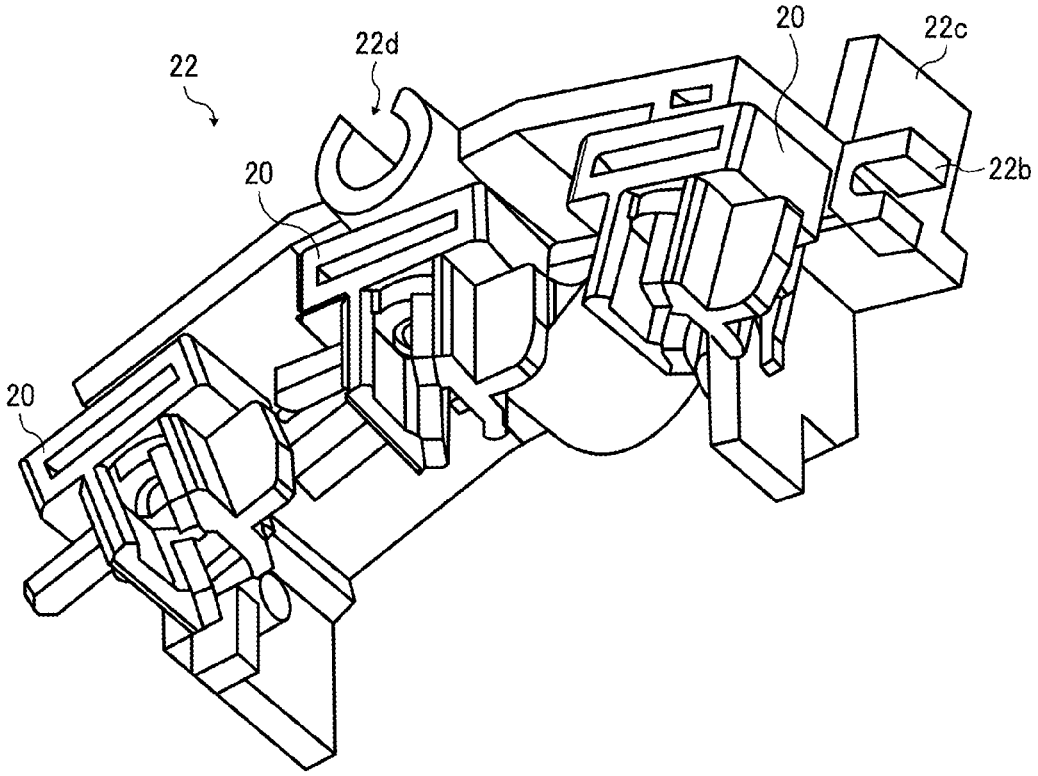
FIG. 9 is a schematic view of a wire cleaner according to an embodiment of the present invention.
Figure 10:
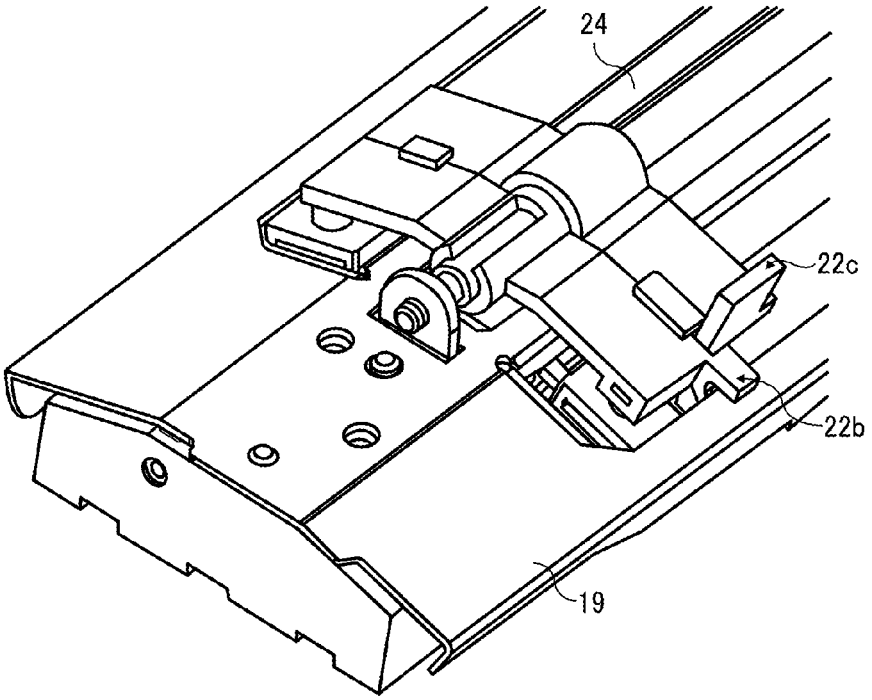
FIG. 10 is a schematic view of a wire cleaner according to an embodiment of the present invention.
Figure 11:
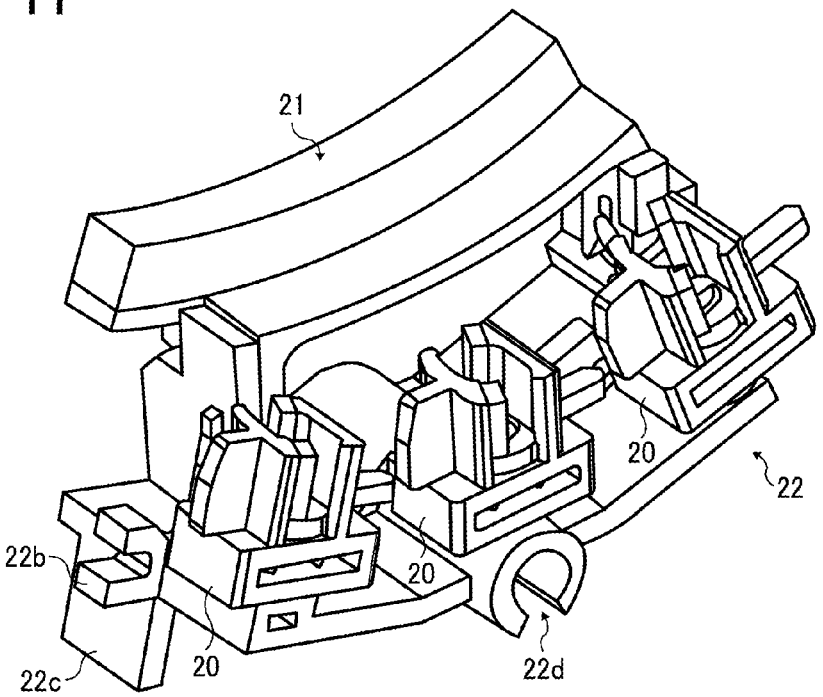
FIG. 11 is a schematic view of a wire cleaner according to an embodiment of the present invention.

Details of the wire cleaner 20 are described below with reference to FIGS. 14 to 17. The first cleaner 20*a*, composed of a glass-containing resin, has two curved surface parts 20*f* having a curvature R of 0.5 for scraping off foreign substances, as illustrated in FIG. 6. Further, the first cleaner 20*a* has the projection 20*d* extending linearly, as illustrated in FIG. 6. By moving the cleaner holder 22 with the projection 20*d* contacting the casing 19 and the first cleaner 20*a* rotated a predetermined degree, the corona wire 17 is brought into cleaning. During the cleaning, the curved surface parts 20*f* are press-contacting the corona wire 17 in opposite directions at different positions. Similarly, the second cleaners 20*b* are press-contacting the corona wire 17 in opposite directions at different positions. With this configuration, different parts on both sides of the surface of the corona wire 17 are cleaned reliably. During an image forming operation, the wire cleaner 20 is positioned at the front side of the charger 5. During one cleaning operation, the wire cleaner 20 reciprocates once in a longitudinal direction, in other words, moves backward (i.e., from the front side to the rear side) and forward (i.e., from the rear side to the front side) once. To increase cleanability, the wire cleaner 20 can reciprocate more than once, for example, twice.

In the cleaning operation, the first cleaner 20*a* scrapes off foreign substances during the backward (i.e., from the front side to the rear side) movement, and the second cleaner 20*b* wipes off the foreign substances during the forward (i.e., from the rear side to the front side) movement. Accordingly, the direction of rotation of the wire cleaner 20 in the backward movement and that in the forward movement are opposite to each other. The direction of rotation is switched at the end of the backward movement when the rib 20*e* is pressed by a projection 25, disposed at a rear part of the charger 5, making the rotation angle 0°. The wire cleaner 20 is brought to a stop with the curved surface parts 20*f* kept away from the corona wire 17. Immediately after the forward movement starts, the projection 20*d* is brought into contact with the casing 19 and the wire cleaner 20 is rotated in the opposite direction. To perform these operations, an opening 26 is provided at a rear side of the casing 19. Similarly, at the end of the forward movement, the rib 20*e* is pressed by a projection 27, disposed at a front part of the charger 5, making the rotation angle 0°. The wire cleaner 20 is brought to a stop with the second cleaners 20*b* kept away from the corona wire 17. Immediately after the backward movement starts, the projection 20*d* is brought into contact with the casing 19 and the wire cleaner 20 is rotated in the opposite direction. To perform these operations, an opening 28 is provided at a front side of the casing 19.

In the present embodiment, the wire, serving as a discharge electrode, is plated with palladium, and the wire cleaner consists of the first cleaner composed of a glass-containing resin and the second cleaner. With such a configuration, the plating can maintain foreign-substance removability without causing peeling off. Thus, even strongly-adhered foreign substances can be easily removed from the wire, suppressing the occurrence of black or white strip-like or band-like abnormal image and/or image density unevenness, and drastically extending the life-span of the charger.

Since the first cleaner 20*a* functions in the backward movement, and separately, the second cleaner 20*b* functions in the forward movement, the cleaners can be downsized compared to a case where both the first and second cleaners 20*a* and 20*b* function in, for example, the backward movement. Moreover, since the wire cleaner 20 is brought away from the corona wire 17 at the end of the cleaning operation, the corona wire 17 can secure appropriate discharge function without causing a wire drift during an image forming operation. Upon contact of the rib 20*e*, formed on the first cleaner 20*a*, with the projection 25 or 27, provided at the rear or front side of the casing 19, respectively, the first cleaner 20*a* is rotated to switch between a state of press-contacting the corona wire 17 and a state of being away from the corona wire 17. As any member for switching the wire cleaner 20 between these two states is not needed, downsizing and cost reduction of the wire cleaner 20 can be achieved.

As the radius of the curved surface part 20*f* becomes smaller and the shape thereof comes closer to an edge, the cleaning ability becomes higher. At the same time, it is more likely that cleaning unevenness is caused in accordance with a possible variation in press-contact state caused in a longitudinal direction. Therefore, the curvature R is set to 0.5. The first cleaner 20*a* is composed of a glass-containing resin. The higher the glass content, the greater the surface roughness and cleaning ability. On the other hand, the smaller abrasion amount of the contact surfaces of the first cleaner 20*a* with the corona wire 17 and the casing 19 prevents lowering of press-contact depth of the first cleaner 20*a* into the the corona wire 17 with time. Accordingly, the first cleaner 20*a* is preferably composed of a glass-containing PC or PPS having a glass content rate of 40%. Preferably, the second cleaner 20*b* is composed of a porous member, such as foamed elastic body, or a fibrous member, such as felt, to reliably grab foreign substances.

Figure 18:
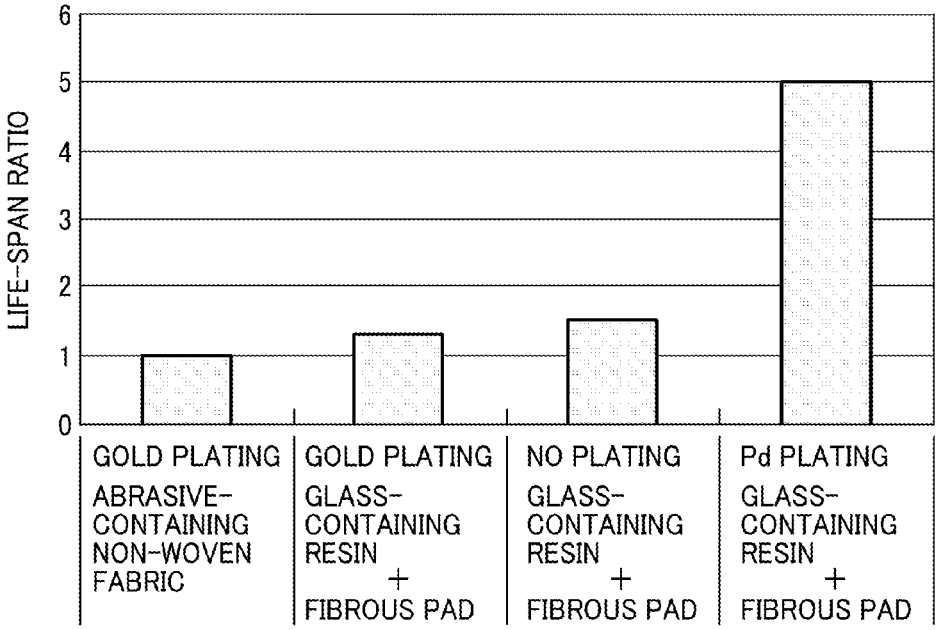
FIG. 18 is a graph showing effects of the present invention.

FIG. 18 is a graph showing the effects of the present invention. A related-art charger generally employs a gold-plated wire and a wire cleaner composed of an abrasive-containing non-woven fabric. When the wire cleaner is replaced with that composed of a glass-containing resin and a fibrous wiping pad, the life-span gets 1.3 times longer. Further improving the cleaning ability of this wire cleaner composed of a glass-containing resin (by increasing the press-contact depth, the wire tension, etc.) may adversely cause the plating to peel off. When a wire with no plating is used, the wire cleaner composed of a glass-containing resin can be improved in cleaning ability because no peeling off occurs. However, such a wire with no plating lacks foreign-substance removability. Thus, the life-span of a charger which employs a wire with no plating and the wire cleaner composed of a glass-containing resin gets just 1.5 times longer than that of the related-art charger. When a wire with palladium plating is used, the wire cleaner composed of a glass-containing resin can be improved in cleaning ability because no peeling off occurs, while the plating secures foreign-substance removability. Thus, the life-span of a charger which employs a wire with palladium plating and the wire cleaner composed of a glass-containing resin gets 5 times longer than that of the related-art charger, which is drastic improvement.

Being composed of a fibrous or porous member, the second cleaner 20*b* can reliably grab the foreign substances having been scraped off by the first cleaner 20*a*. As each of the first cleaner 20*a* and the second cleaner 20*b* includes a pair of members that press-contact the corona wire 17 in opposite directions to each other at different positions with respect to the direction of movement thereof, different parts on both sides of the surface of the corona wire 17 can be cleaned reliably.

As the rib 20*e*, serving as the release member, is provided for releasing the first and second cleaners 20*a* and 20*b* from press-contacting the corona wire 17, the first and second cleaners 20*a* and 20*b* are brought away from the corona wire 17 during an image forming operation, and the corona wire 17 can secure appropriate discharge function without causing a wire drift. As the directions of movement of the first cleaner 20*a* and the second cleaner 20*b* while press-contacting the corona wire 17 are opposite to each other, the wire cleaner 20 can be more downsized compared to a case in which the first cleaner 20*a* and the second cleaner 20*b* move in the same direction. As each of the first and second cleaners 20*a* and 20*h* is switched between a state of press-contacting the corona wire 17 and a state of being away from the corona wire 17 by its rotation, any member for switching the wire cleaner 20 between these two states is not needed. Therefore, downsizing and cost reduction of the wire cleaner 20 can be achieved.

In a related-art scorotron charger, discharge products, such as ozone, nitrogen oxide, and nitrates, accumulate on and adhere to a grid electrode, and may further adhere to the surface of a photoreceptor disposed immediately below the charger while the image forming apparatus is idle after completion of an image forming operation. Having water-absorbing property, the discharge products can bind to moisture in the air to lower surface resistivity of the photoreceptor. If an electrostatic latent image is formed on a low-resistivity surface of the photoreceptor, a flow is generated in electrification charge and causes abnormal image (blurred image), which looks as if it has been scratched. Moreover, if the discharge products further penetrate into the surface layer of the photoreceptor immediately below the charger, the capacitance is increased. A portion where the capacitance is increased is lowered in surface potential. Such a portion causes an increase in image density, resulting in black band-like image. Such abnormal image is not produced by a brand-new charger but is produced by a charger having been deteriorated over time, affecting the life-span.

During an image forming operation, discharge products are removed from the vicinity of the charger by driving a fan. On the other hand, while the image forming apparatus is idle after completion of an image forming operation or is shut down, the fan is stopped, causing blurred or black band-like image. To prevent the occurrence of abnormal image, one approach involves keeping the fan driving even after completion of an image forming operation to keep removing discharge products from the vicinity of the charger. This approach requires the fan to keep driving even in standby state. Therefore, the image forming apparatus is not allowed to shut down immediately after completion of an image forming operation. Alternatively, in the case in which the image forming apparatus is shut down, it is required that the fan be driven by an external power source. Accordingly, various problems may arise such that the operability worsens, the consumption power increases, and the structure becomes complicated. Specifically, upon occurrence of blurred image, discharge products can be removed by making the photoreceptor rotate so as to refresh the surface of the photoreceptor with cleaning blade. However, this approach reduces productivity because image forming operation cannot be performed while the photoreceptor is subjected to the refreshment.

To solve these problems, a technique of forming a zeolite-containing coat layer on the grid electrode has been proposed. The zeolite-containing coat layer adsorbs and decomposes discharge products to prevent them from adhering to or penetrating into the photoreceptor. In this technique, however, there is a possibility that the adsorbed discharge products are released depending on the usage environment, which is an adverse effect of formation of the coat layer. One object of the present invention is to provide a technique for drastically extending the life-span of charger by preventing the occurrence of blurred image or black band-like image without causing worsening in operability, increase in consumption power, more complicated structure, and decrease in productivity. Thus, to achieve this object, according to an embodiment of the present invention, a coat layer containing nickel as a main component and a fluorine resin is formed on the grid electrode. By this technique, the surfaces of the grid electrode and casing are smoothened and given water repellency. With this configuration, adherence and accumulation of discharge products to/on the grid electrode and casing, generally occurred during an image forming operation, can be suppressed. Therefore, the occurrence of blurred image or black band-like image, generally occurred due to adherence or penetration of discharge products to/into photoreceptor, can be suppressed.

Referring to FIG. 3, the grid electrode 18 and the casing 19 each have a coat layer containing nickel as a main component and a fluorine resin. The coat layer has a bilayer structure. The lower layer is a nickel layer formed on a mother material, and the upper layer contains nickel as a main component and a fluorine resin. The thickness of the coat layer, including these two layers, is from 3 to 50 μm. The homogeneity of the layer is ±0.5%. The grid electrode 18 is formed into a mesh having an opening width of 400 μm. A typical fluorine-resin coat has a thickness of from 300 to 400 μm, which cannot be used for the grid electrode 18 having a mesh shape. The coat layer containing nickel as a main component and a fluorine resin can be used for the grid electrode 18 having a mesh shape having fine openings.

As nickel is serving as the main component, the coat layer of the present embodiment has extremely higher hardness than related-art fluorine-resin coat layers. The micro-Vickers hardness thereof is HV400 or more. The coat layer never peels off even when the grid cleaner 21, composed of foamed urethane, etc., slides on the surface of the grid electrode 18. Since a voltage is applied to the grid electrode 18 and the casing 19, the coat layers formed thereon are required to have conductivity. A typical fluorine-resin coat layer is insulating, but the coat layer of the present embodiment in which nickel and a fluorine resin are uniformly distributed is conductive. The grid electrode 18 and casing 19 having the coat layer have smooth surfaces with high water repellency. Therefore, adherence and accumulation of discharge products to/on the grid electrode and casing can be suppressed. Furthermore, the occurrence of abnormal image, generally occurred due to adherence or penetration of discharge products to/into photoreceptor, can be suppressed. As a result, the life-span of the charger 5 is extended. As the thickness becomes greater, the coat layer is more likely to peel off. As the thickness becomes smaller, discharge products more easily adhere to the coat layer.

Figure 19:
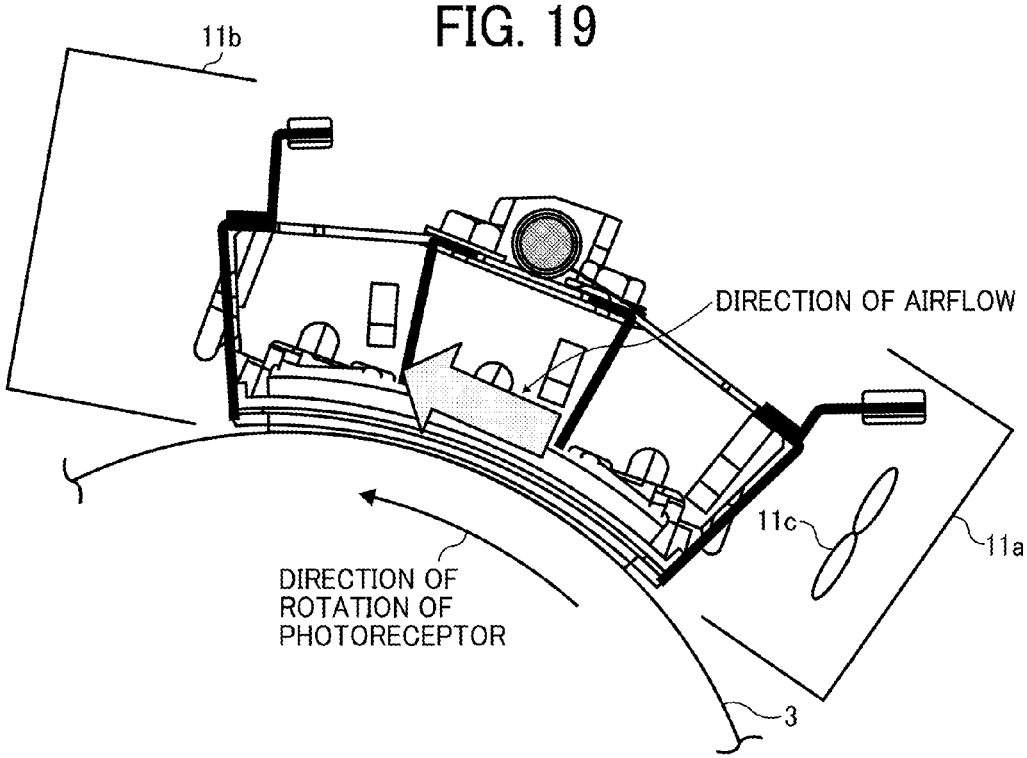
FIG. 19 is a schematic view of a fan duct according to an embodiment of the present invention.

Next, details of the fan duct 11 provided around the charger 5 are described below. The fan duct 11 has an intake part 11*a* and an exhaust part 11*b*, as illustrated in FIG. 19. Inside the intake part 11*a*, an intake fan 11*c* to suck the air inward is provided. Once the intake fan 11*c* comes into operation, an air flow which flows from the right side to the left side in FIG. 19 is formed. When the flow rate is too low, it is not possible to sufficiently exhaust discharge products, and the discharge products more easily adhere to and accumulate on the charger 5. In the present embodiment, the intake fan 11*c* is operated so that the flow rate becomes or exceeds 0.3 m/sec at the vicinity of the charger 5. With this configuration, adherence and accumulation of the discharge products to/on the charger 5 can be more suppressed.

The effects of the coat layer formed on the grid electrode 18 were demonstrated by the following experiments. An image formation was performed under a high-temperature high-humidity condition, in which blurred image easily occur. Immediately after completion of the image formation, the image forming apparatus was turned off (i.e., the fan was turned off) and left for 17 hours, and an image formation was performed again thereafter. In the case in which the coat layer was not formed, blurred image occurred and white spots were observed at the area corresponding to a portion of the photoreceptor positioned immediately below the charger. In the case in which the coat layer was formed, blurred image did not occur. An image formation was also performed under a low-temperature low-humidity condition, in which black band-like image easily occur. Immediately after completion of the image formation, the image forming apparatus was turned off (i.e., the fan was turned off) and left for 14 hours, and an image formation was performed again thereafter. In the case in which the coat layer was not formed, black band-like image occurred at the area corresponding to a portion of the photoreceptor positioned immediately below the charger, where the surface potential had been reduced by approximately 30 V. In the case in which the coat layer was formed, the degree of the occurrence of black band-like image had improved, because the surface potential had been reduced only by 20 V. The comparison between the case in which the coat layer is formed only on the grid electrode 18 and the case in which the coat layer is formed only on the casing 19 indicates that the former case is more advantageous in terms of image quality. Accordingly, even in the case in which the coat layer is formed only on the grid electrode 18, the occurrence of abnormal image, caused by discharge products, can be effectively suppressed.

According to an embodiment of the present invention, a drive unit provided to the main body of the image forming apparatus is controlled by a controller to rotate the feed screw to move the cleaner holder 22 in a longitudinal direction of the charger 5. Thus, the charger 5 is subjected to cleaning automatically and regularly, thus effectively suppressing the occurrence of abnormal image and extending the life-span of the charger.

Other than the full-color copier described above, the image forming apparatus according an embodiment of the present invention includes a printer, a monochrome copier, a facsimile machine, a plotter, and a combined machine thereof. In addition, the image forming apparatus according an embodiment of the present invention further includes a full-color copier employing a quadruple-tandem direct transfer method or a single-drum intermediate transfer method, and a monochrome machine employing a single-drum direct transfer method.

What is claimed is:

1. A charger, comprising:

a discharge electrode composed of a wire, the wire having a surface plated with palladium;

a cleaner to remove foreign substances adhered to the discharge electrode, the cleaner including:

a first cleaner, composed of a glass-containing resin, to scrape off the foreign substances by press-contacting the wire while moving; and a second cleaner to wipe off the foreign substances by press-contacting the wire while moving;

a holder to movably hold the cleaner in a direction parallel to the discharge electrode; and a grid electrode having a coating layer including nickel as a main component and a fluorine resin.

2. The charger according to claim 1, wherein the second cleaner is composed of a fibrous member or a porous member.

3. The charger according to claim 1, wherein each of the first and second cleaners includes a pair of members to press-contact the discharge electrode in opposite directions to each other at different positions with respect to a direction of movement of the members.

4. The charger according to claim 1, further comprising:

a release member to release the first and second cleaners from press-contacting the discharge electrode.

5. The charger according to claim 1, wherein a direction of movement of the first cleaner while press-contacting the discharge electrode is opposite to a direction of movement of the second cleaner while press-contacting the discharge electrode.

6. The charger according to claim 1, wherein each of the first and second cleaners is switched between a state of press-contacting the discharge electrode and a state of being away from the discharge electrode by its rotation.

7. The charger according to claim 1, wherein the coating layer has a thickness of from 3 to 50 μm.

8. An image forming apparatus, comprising:

an image carrier;

the charger according to claim 1 to charge a surface of the image carrier;

a latent image forming device to form an electrostatic latent image on the charged surface of the image carrier;

a developing device to develop the electrostatic latent image into a toner image;

a transfer device to transfer the toner image from the image carrier onto a recording medium; and a fixing device to fix the toner image on the recording medium.

9. The image forming apparatus according to claim 8, wherein the charger is detachably mountable on the image forming apparatus.

10. The image forming apparatus according to claim 8, further comprising:

a driver for driving the charger; and a controller for controlling the driver.

11. The image forming apparatus according to claim 8, further comprising:

a fan duct including a fan, to generate an air flow in the vicinity of the charger, the air flow having a flow rate of 0.3 m/sec or more.

12. The image forming apparatus according to claim 8, wherein the grid electrode is disposed between the wire and the surface of the image carrier.

13. The image forming apparatus according to claim 8, further comprising a casing serving as an opposite electrode to the wire.

14. The image forming apparatus according to claim 13, wherein each of the wire, the grid electrode, and the casing is held by a front part and a rear part of the charger.

15. The charger according to claim 1, wherein the second cleaner is attached to the first cleaner.

16. The charger according to claim 1, wherein the cleaner further includes:

a hole to which a support shaft is inserted, a projection, and a rib.

17. The charger according to claim 16, wherein the cleaner is rotatably supported by a cleaner holder.

18. The charger according to claim 17, wherein the cleaner holder has a support shaft.

19. The charger according to claim 18, wherein the support shaft is inserted into the hole of the cleaner and retained with a retaining ring.

20. The charger according to claim 18, wherein the cleaner holder has a rotation stopper, a detection surface, and a hole, wherein the hole is provided on an upper part and its inner surface is formed into a helical shape.

* * * * *